US011618068B2

(12) United States Patent
Dallan

(10) Patent No.: US 11,618,068 B2
(45) Date of Patent: Apr. 4, 2023

(54) SHEET METAL BENDING MACHINE AND SHEET METAL BENDING METHOD

(71) Applicant: DALLAN S.P.A., Castelfranco Veneto (IT)

(72) Inventor: Sergio Dallan, Castelfranco Veneto (IT)

(73) Assignee: DALLAN S.P.A., Castelfranco Veneto (IT)

( * ) Notice: Subject to any disclaimer, the term of this patent is extended or adjusted under 35 U.S.C. 154(b) by 0 days.

(21) Appl. No.: 16/903,556

(22) Filed: Jun. 17, 2020

(65) Prior Publication Data

US 2020/0398327 A1 Dec. 24, 2020

(30) Foreign Application Priority Data

Jun. 20, 2019 (IT) ..... 102019000009657

(51) Int. Cl.
*B21D 22/02* (2006.01)
*B21D 19/04* (2006.01)

(52) U.S. Cl.
CPC ..... *B21D 22/02* (2013.01); *B21D 19/043* (2013.01)

(58) Field of Classification Search
CPC ..... B21D 5/04; B21D 5/045; B21D 22/10; B21D 19/08; B21D 19/082; B21D 5/16; B21D 19/04; B21D 19/043; B21D 22/02; B21D 19/084
USPC ..... 72/380, 386
See application file for complete search history.

(56) References Cited

U.S. PATENT DOCUMENTS 1,979,472 A * 11/1934 Kelley ..... B21D 19/08 72/415
4,520,646 A * 6/1985 Pauzin ..... B21D 5/045 72/313
4,756,863 A * 7/1988 Petershofer ..... B29C 53/04 425/374

(Continued)

FOREIGN PATENT DOCUMENTS

CN 107824662 A * 3/2018
DE 10223637 A1 * 12/2003 ..... B21D 5/04

(Continued)

OTHER PUBLICATIONS

Search Report for IT2019000009657 dated Feb. 12, 2020.

*Primary Examiner* — Edward T Tolan
(74) *Attorney, Agent, or Firm* — ArentFox Schiff LLP; Michael Fainberg

(57) ABSTRACT

A sheet metal bending machine includes a sheet metal presser defining a first support surface supporting a first sheet metal portion, a bending punch movable with respect to the first support surface between a passive position, in which it is raised with respect to the first support surface, and an active position, in which it is pressed against the first support surface to lock the first sheet metal portion on the sheet metal presser with a punch edge, and a bending die defining a second support surface. The presser and the die are movable with respect to one another substantially in parallel with a direction transverse to the first and second bending edges to switch from the partial to a complete sheet metal bending configuration, in which the distance is reduced to press partially curved section towards said punch edge, thereby deforming it further and increasing the curvature of sheet.

13 Claims, 13 Drawing Sheets

(56) References Cited

U.S. PATENT DOCUMENTS 5,123,270 A * 6/1992 Salvagnini ..... B21D 5/045 72/322
5,253,502 A * 10/1993 Poletti ..... B21D 5/01 72/383
5,572,901 A * 11/1996 Wilhelm ..... B21D 5/045 72/461
6,196,041 B1 * 3/2001 Codatto ..... B21D 5/04 72/322
6,336,399 B1 * 1/2002 Matsuoka ..... B21D 19/086 72/445
6,928,848 B2 * 8/2005 Golovashchenko ... B21D 39/02 29/243.58
7,013,783 B2 * 3/2006 Matsuoka ..... B21D 28/32 100/291
7,237,419 B2 * 7/2007 Fielder ..... B21D 5/04 72/309
8,256,119 B2 * 9/2012 Bolzoni ..... B21K 23/00 72/352
8,776,570 B2 * 7/2014 Maeda ..... B21D 22/02 72/380
9,908,163 B1 * 3/2018 Rose ..... G01B 11/26
2003/0061852 A1 * 4/2003 Yamano ..... B21D 5/01 72/306
2019/0247905 A1 * 8/2019 Aigner ..... B21D 5/04
2020/0338617 A1 * 10/2020 Yokoi ..... B21D 19/08

FOREIGN PATENT DOCUMENTS

EP 0610706 A1 8/1994
FR 3006917 A1 * 12/2014 ..... B21D 5/04
FR 3006917 A1 12/2014
JP 2005305493 A 11/2005
JP 2006255770 9/2006
KR 101227456 B1 * 2/2013 ..... B21D 5/04

* cited by examiner

SHEET METAL BENDING MACHINE AND SHEET METAL BENDING METHOD

CROSS-REFERENCE TO RELATED APPLICATION

This application claims priority to Italian Patent Application No. 102019000009657 filed on Jun. 20, 2019, the entire contents of which is hereby incorporated in its entirety by reference.

FIELD OF THE INVENTION

The present invention relates to a sheet metal bending machine and to a sheet metal bending method.

BACKGROUND OF THE INVENTION

Bending machines are known that comprise a fixed die and are able to bend metal sheets at bending angles equal to or greater than 90°. More specifically, as shown schematically in FIGS. 1 to 4, a bending machine of this known type comprises:

- a sheet metal presser A intended to receive a first sheet metal portion L1 so as to support it;
- a bending punch B, intended to press the first sheet metal portion against the sheet metal presser during use; and
- a bending die C, which receives a second sheet metal portion L2 so as to support it.

The second sheet metal portion is adjacent to the first sheet metal portion and is intended to be bent with respect thereto following a relative movement between the bending die and the sheet metal presser.

The sheet metal presser A and the bending die B are arranged in positions that are adjacent but are separated by a distance that varies on the basis of the thickness of sheet metal to be bent. Sheet metal is bent between the two portions along a separation zone between the sheet metal presser and the bending die at the bending edge of the punch. The curvature of sheet metal in the bending zone is defined by the radius of curvature of the bending edge D of the punch.

In terms of operation, as shown in FIGS. 1 to 4, the thrust of the bending punch B causes the sheet metal presser A to be lowered with respect to the bending die C in a Y direction that is orthogonal to the support plane of the sheet on the sheet metal presser and on the bending die. The first sheet metal portion, which is held on the sheet metal presser by the action of the bending punch, follows the movement of the sheet metal presser and drags the second sheet metal portion together therewith. The latter, which scrapes against the bending die, which instead is maintained fixed, is progressively arranged between the bending die and the sheet metal presser, thereby deforming until it bends around the bending edge of the punch.

While carrying out its function, the bending machine has the following inconveniences:

- impossibility to obtain bending angles greater than 90° since sheet metal cannot be pushed beyond the perpendicular passing through the bending edge of the bending punch;
- impossibility to even obtain a bending angle equal to 90° due to the elastic return of sheet metal, and
- scraping on the bending die ruins the sheet metal surface.

Bending machines such as machines comprising an oscillating table, which overcome the above-mentioned limitations and that make it possible in particular to adjust the bending angle of sheet metal are already available on the market. By means of these machines, it is possible to effectively reach and possibly also exceed a bending angle of 90°, while preserving the surface integrity of sheet metal.

However, the limitations of these machines lie in their mechanical and control complexity.

Therefore, a need is felt to provide a bending machine that makes it possible to adjust the bending angle of sheet metal and to effectively reach and possibly exceed an angle of 90° while preserving the surface integrity of the sheet, and which is simultaneously mechanically simple to produce and to control.

SUMMARY OF THE INVENTION

The object of the present invention is therefore to eliminate all or some of the drawbacks of the prior art cited above by providing a sheet metal bending machine that makes it possible to adjust the bending angle of the sheet and is simultaneously mechanically simple to produce and to control.

Another object of the present invention is to provide a sheet metal bending machine that is able to bend the sheet while simultaneously preserving the surface integrity thereof.

Yet another object of the present invention is to provide a sheet metal bending machine that is simple and economic to produce.

Still another object of the present invention is to provide a sheet metal bending machine that is operatively simple to manage.

Yet another object of the present invention is to provide a sheet metal bending method that makes it possible to adjust the bending angle of sheet metal and is simultaneously mechanically simple to implement.

The technical features of the present invention, according to the above-mentioned objects, may clearly be seen from the content of the claims given below and advantages thereof will become more apparent from the following detailed description, given with reference to the attached drawings that depict one or more embodiments thereof by way of non-limiting example.

DETAILED DESCRIPTION

Figure 1:
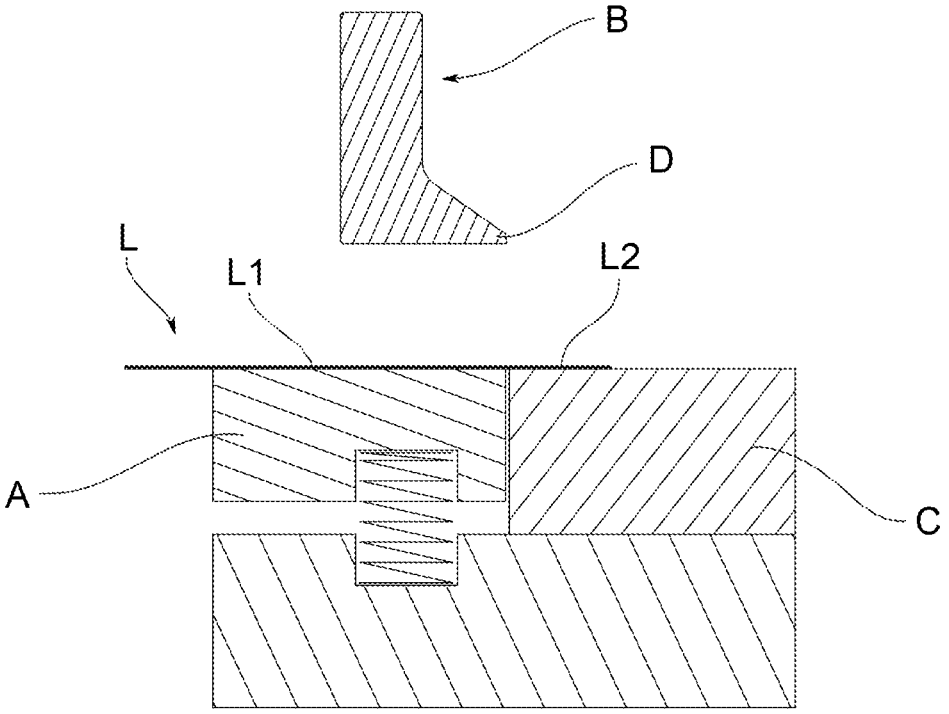
FIGS. 1 to 4 show schematically the operating steps of bending sheet metal at 90° using a traditional bending machine comprising a fixed die.
Figure 2:
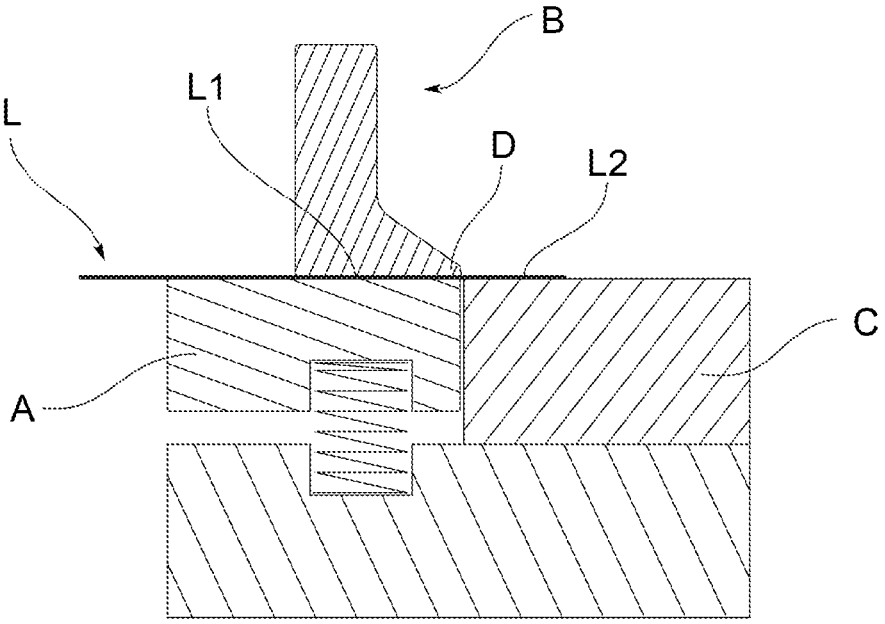
Figure 3:
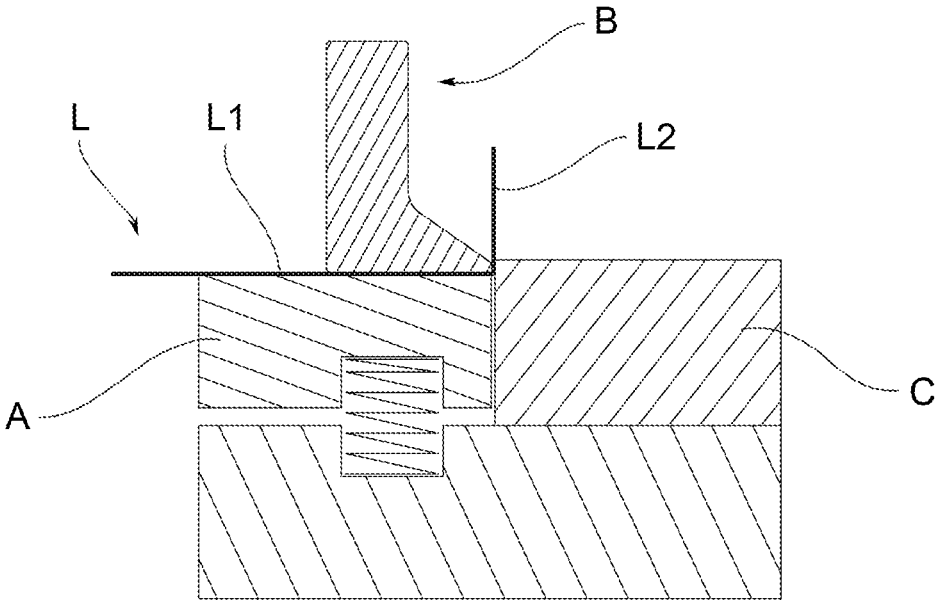
Figure 4:
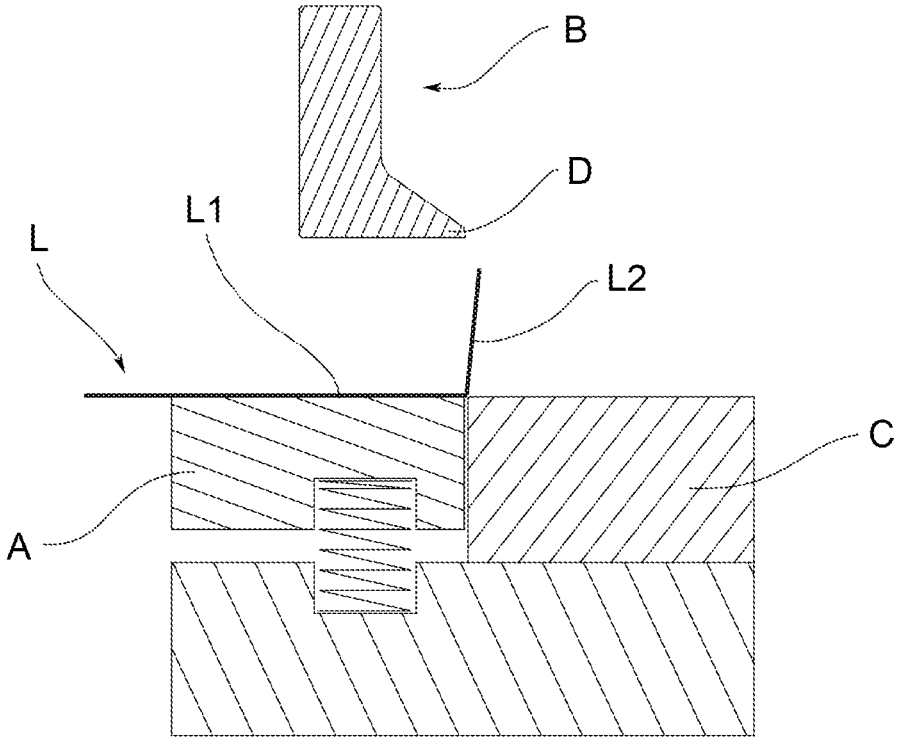
Figure 5:
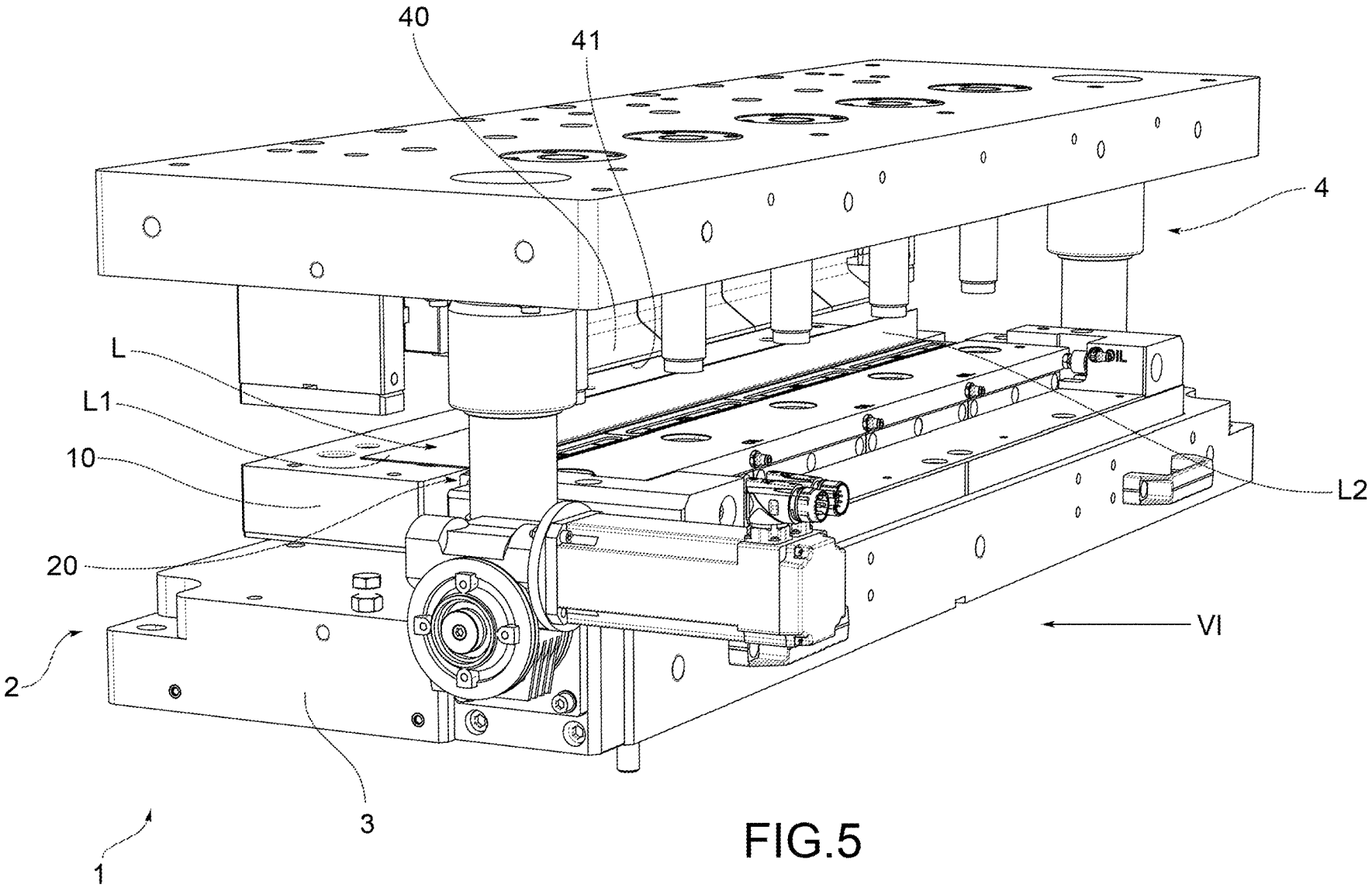
FIG. 5 shows a perspective view of a bending machine according to a preferred embodiment of the present invention.
Figure 6:
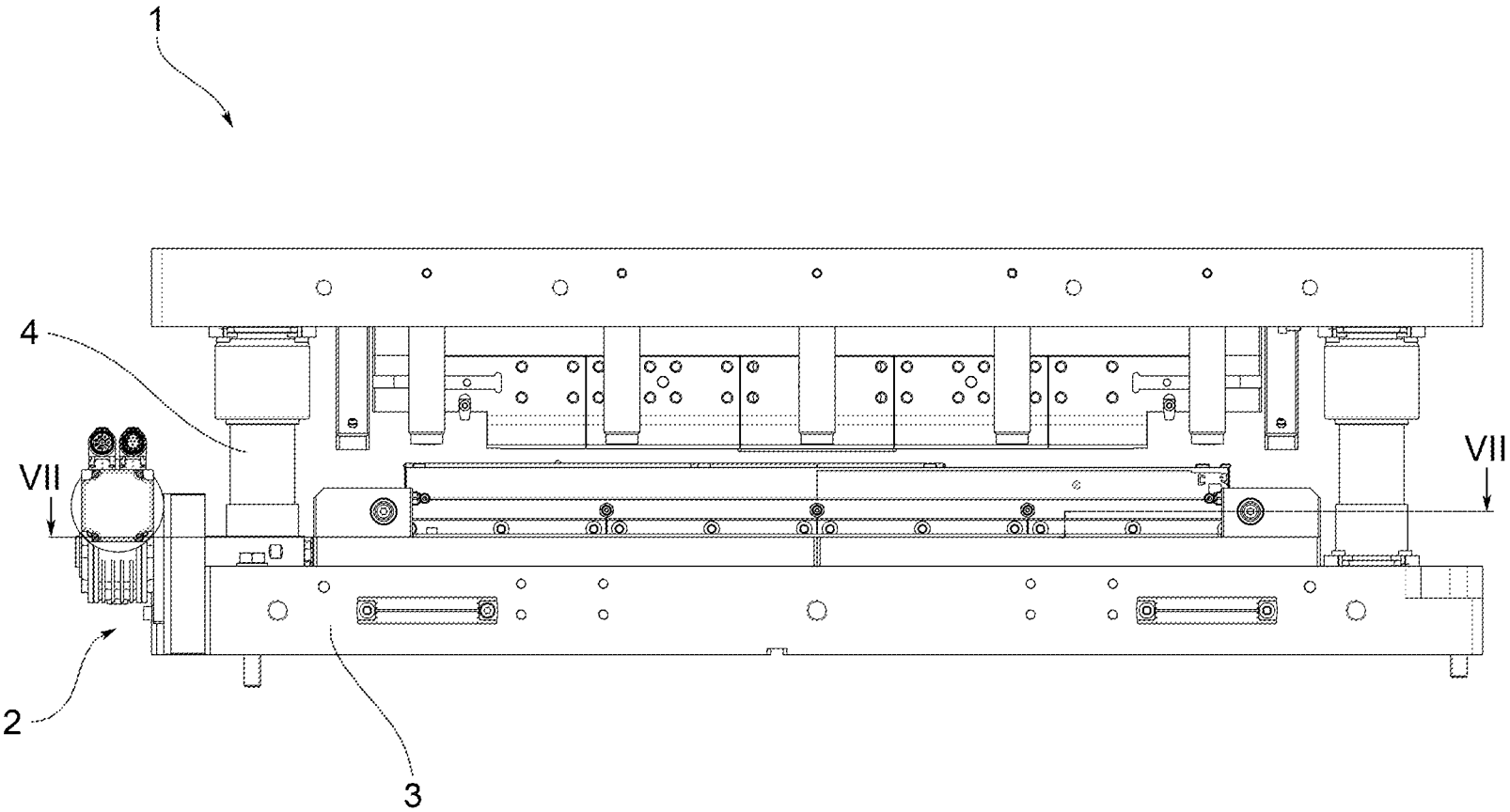
FIG. 6 shows a lateral orthogonal view of the bending machine in FIG. 5 according to the arrow VI shown therein.

With reference to the attached drawings, 1 indicates, as a whole, a sheet metal bending machine according to the present invention.

As shown in particular in FIGS. 8 to 13, the sheet metal bending machine 1 comprises a sheet metal presser 10, which defines on its top a first support surface 11 that is intended to support a first portion L1 of sheet metal L.

The first support surface 11 is partially delimited by a first bending edge 12.

Figure 9:
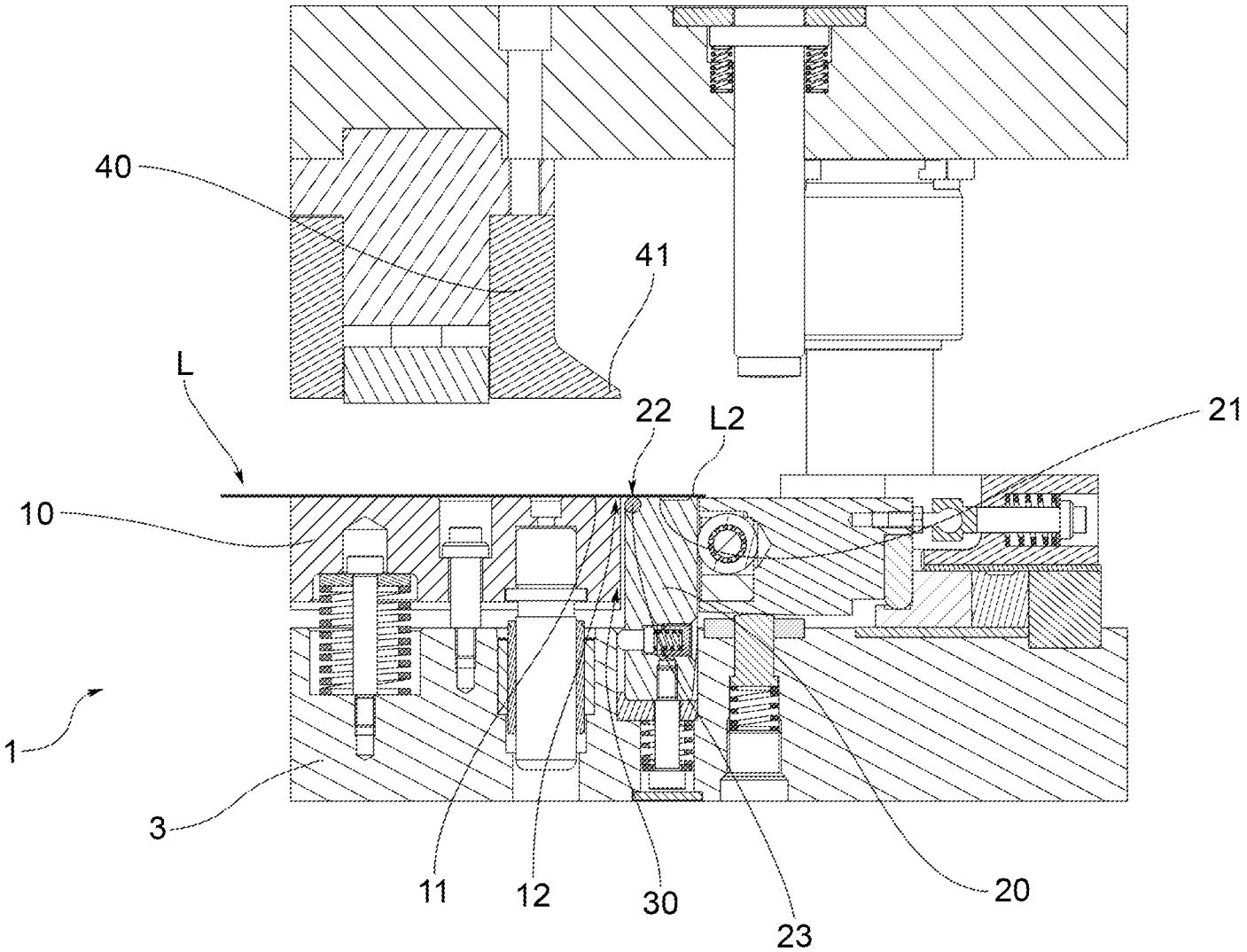
FIGS. 9 to 13 show with a few orthogonal sectional views the operating steps of bending a sheet at 90° using the bending machine shown in FIG. 5.
Figure 10:
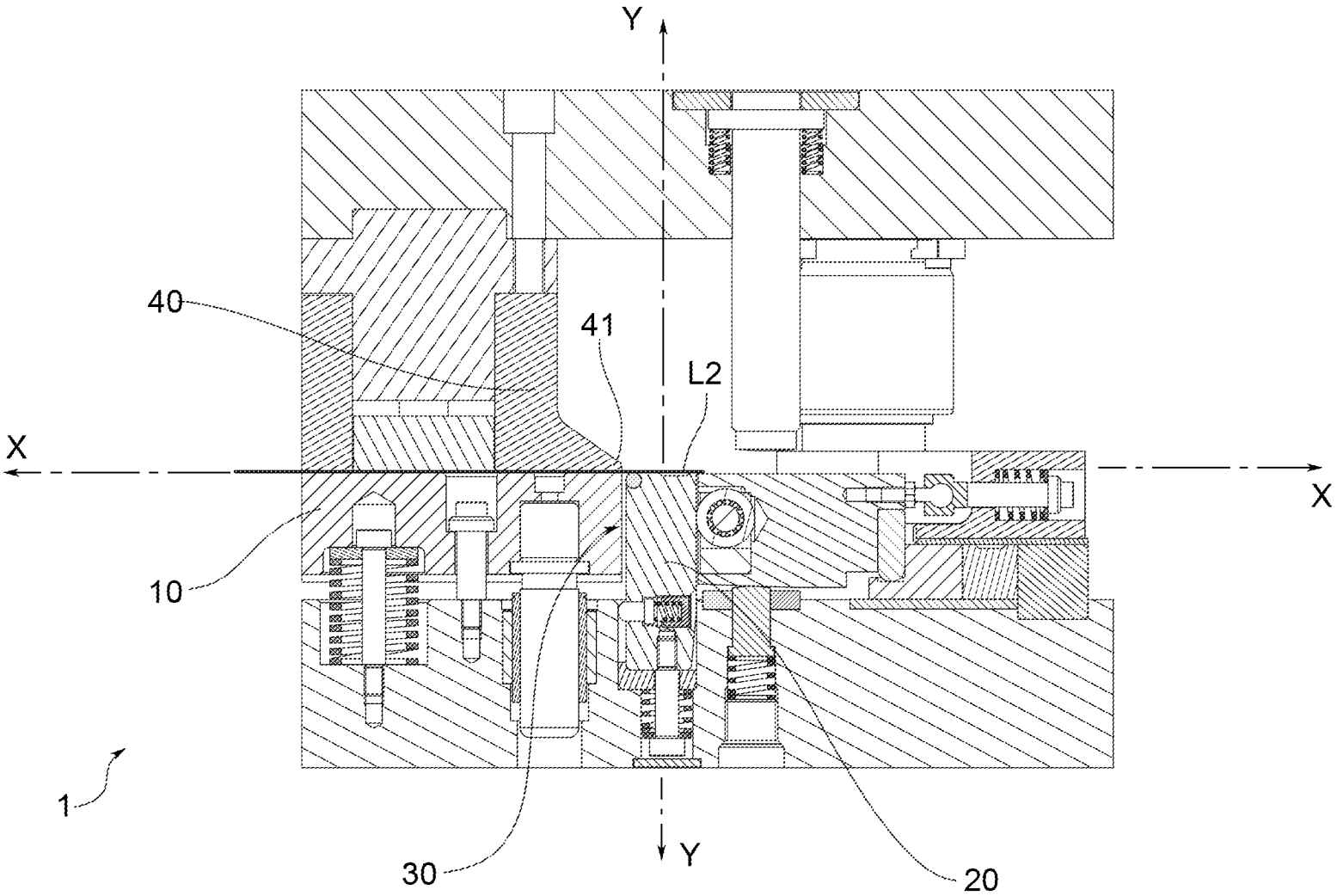
Figure 14:
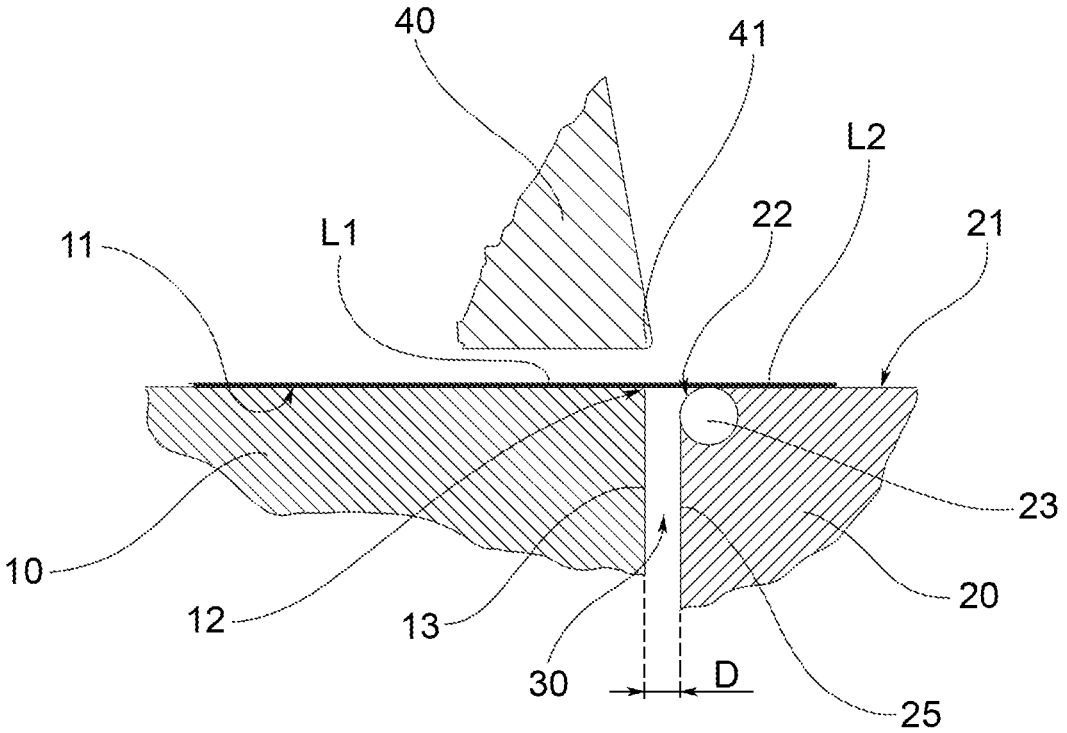
FIGS. 14 to 18 show enlarged details of FIGS. 9 to 13, respectively, which relate to the sheet bending zone.
Figure 15:
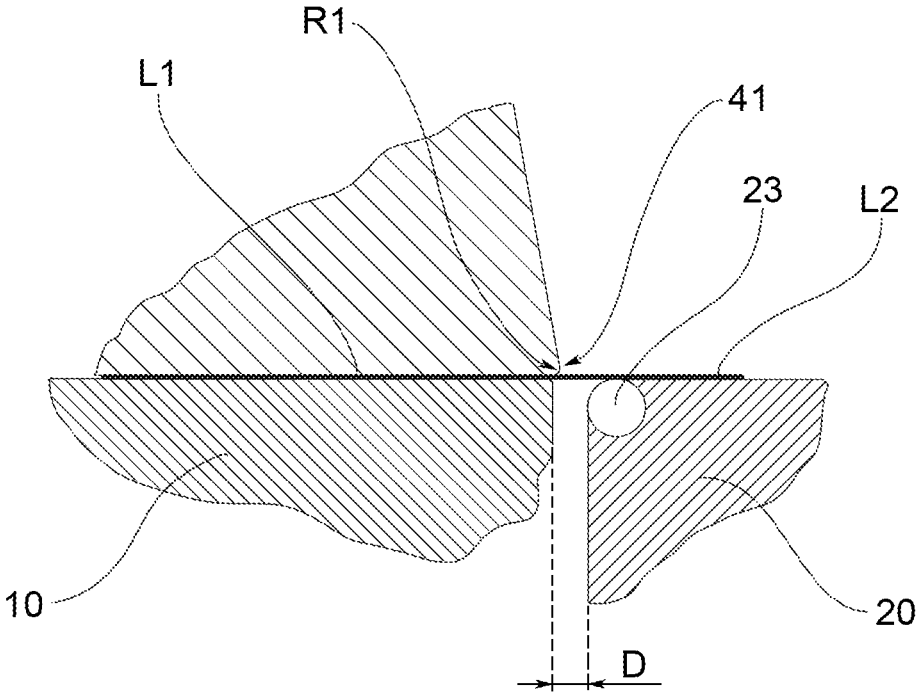

The sheet metal bending machine 1 further comprises a bending punch 40, which is movable with respect to the first support surface 11 between:

- a passive position, in which it is raised with respect to said first support surface 11 (FIGS. 9 to 14), and
- an active position, in which it is pressed against the first support surface 11 in order to lock the first sheet metal portion on the sheet metal presser 10 during use (FIGS. 10 and 15).

The bending punch 40 is provided with a punch edge 41 having a predefined radius of curvature R1.

Operatively, the bending punch 40 is configured such that, in the active position, the bending punch 40 is positioned on the first support surface 11 with the punch edge 41 arranged near the first bending edge 12 of the sheet metal presser 10.

The sheet metal bending machine further comprises a bending die 20, which defines on its top a second support surface 21 that is intended to support a second portion L2 of sheet metal L.

The second support surface 21 is partially delimited by a second longitudinal bending edge 22.

As shown in the attached drawings, the bending die 20 is arranged at a distance D from said sheet metal presser 10 with the second bending edge 22 parallel to and opposite the first bending edge 12.

As will be resumed in the following description, the distance D is variable during operations of bending the sheet.

In particular, as shown in the attached drawings, a gap 30 is defined between the sheet metal presser 10 and the bending die 20, which is delimited by a first side wall 13 of the sheet metal presser 10 and a second side wall 25 of the bending die 20, which face one another.

Advantageously, the sheet metal presser 10, the bending die 20 and the bending punch 40 are associated with the same support structure 2 of the sheet metal bending machine 1. In particular, as shown in the attached drawings, the support structure 2 comprises:

- a lower bench 3, with which the sheet metal presser 10 and the bending die 20 are directly associated; and
- a frame 4 for supporting the bending punch and the relative actuation means.

The sheet metal presser 10 and the bending die 20 are movable relative to one another substantially in parallel with a direction Y that is orthogonal to the first and second support surfaces 11, 12.

Due to this movement possibility, during use, the bending die 20 and the sheet metal presser 10 may pass between:

- a sheet metal supporting configuration (FIGS. 9 and 10; FIGS. 14 and 15), in which the first support surface 11 and the second support surface 21 together with the relative bending edges 12, 22 are coplanar to one another and define, during use, a support plane for the sheet L that has not been bent, and
- a partial sheet metal bending configuration (FIGS. 11 and 16), in which, with the bending punch 40 held in the active position, the second support surface 21 together with the relative second bending edge 22 is arranged higher than the first support surface 11.

Operatively, when passing from the sheet supporting configuration to the partial sheet metal bending configuration, the second sheet metal portion L2 is inclined with respect to the first sheet metal portion L1, thereby generating, near the punch edge 41, a partially curved section T on the sheet that is deformed in the elastic-plastic field.

When passing between the sheet metal supporting configuration and the partial sheet metal bending configuration, the relative movement between the bending die and the sheet metal presser substantially in parallel with the direction Y, that is orthogonal to the first and second support surfaces 11, 12, is essential. Advantageously, this relative movement may be obtained by moving only the sheet metal presser, only the bending die, or both these components.

The expression "movable substantially in parallel with the orthogonal direction Y" means that the main component of the movement is parallel to the orthogonal Y direction, but secondary motion components that are not parallel to the Y direction may be provided.

Preferably, the sheet metal presser 10 is movable with respect to the bending die 20 substantially in parallel with the Y direction that is orthogonal to the first and second support surfaces 11, 12, while the bending die 20 is fixed along said direction Y.

In particular, as shown schematically in the attached drawings, the sheet metal presser 10 is constituted by a support that is elastically yielding under the thrust of the bending punch 40.

The sheet metal presser 10 and the bending die 20 are also movable relative to one another substantially in parallel with a direction X that is transverse to said first bending edge 12 and to said second bending edge 22.

Due to this additional movement possibility, during use the bending die 20 and the sheet metal presser 10 may pass from the partial sheet metal bending configuration (FIGS. 11 and 16) to a complete sheet metal bending configuration (FIGS. 12 and 17), in which the bending die 20 and the sheet metal presser 10 are moved closer to one another, thereby reducing the distance D between them.

Operatively, when passing from the partial sheet metal bending configuration to the complete sheet metal bending configuration, the partially curved section T of the sheet metal L is pressed towards the punch edge 41 so as to be further deformed and to increase the curvature of the sheet.

As will be resumed in the following when describing the bending method according to the present invention, the sheet metal bending machine 1 according to the present invention is configured to bend the sheet in two separate successive bending steps, which are achieved by different relative movements between the bending die and the sheet metal presser.

The division of the bending process into two separate steps (partial bending and complete bending) makes it possible to take advantage of the effects of the deformation in the elastic-plastic field induced on the sheet during the partial bending step.

More specifically, partial bending of the sheet causes—near the punch edge 41—a deformed section T that has a differentiated radius of curvature along its extension. The radius of curvature is smallest at the punch edge 41 (substantially equal to the radius of curvature R1 of the punch edge 41) and progressively increases as it moves away from the punch edge 41, that is as it moves closer to the point where the shear force generated by the vertical offset between the bending die and the sheet metal presser is applied. This phenomenon is linked to the fact that the bending moment applied to the second portion L2 of sheet metal is not constant, but is proportional to the application arm of the bending force applied to the second sheet metal portion. The bending moment is greatest at the punch edge and is zero at the point when the shear force is applied. This causes a state of deformation differentiated on the curved section T that therefore generates a curvature that decreases (i.e. increasing radius of curvature) from the zone close to the punch edge.

During the step in which bending is completed, which is achieved by moving the bending die and the sheet metal presser closer together in the transverse X direction, the curved section T is pressed. This pressing causes an increase in the inclination of the second portion L2 of sheet metal and therefore of the final bending angle. By accurately controlling the extent of pressing (that is the movement in the transverse direction between the die and the sheet metal presser), it is therefore possible to adjust the final bending angle.

Furthermore, by taking into account the fact that the curved section T does not follow the curvature of the punch edge and extends beyond the punch edge (as shown in particular in FIG. 16), pressing in the transverse direction may be forced until angles are obtained that exceed the perpendicular passing through the punch edge. In this way, for example, it is possible to force bending of an additional angle $\gamma$ beyond 90° in order to compensate for the elastic return of the sheet and thus to obtain a final bending angle of 90°.

Preferably, as shown in the attached drawings, an idle roller 23 is positioned along the second bending edge 22 of the bending die 20 and is rotatably associated with the body of the bending die 20 such that the axis of rotation is parallel to the second bending edge 22. The idle roller 23, therefore, defines the second bending edge 22, which is intended to come into contact with the surface of the second sheet metal portion L2. In this way, friction between sheet metal and the bending die is reduced, thereby allowing sheet metal to slide on the bending die without significant scraping. This is beneficial to surface integrity of sheet metal.

Operatively, when passing between the partial sheet metal bending configuration and the complete sheet metal bending configuration, the relative movement between the bending die and the sheet metal presser substantially in parallel with the direction X, that is transverse to said first and second bending edges, is essential. Advantageously, this relative movement may be obtained by moving only the sheet metal presser, only the bending die, or both components.

The expression "movable substantially in parallel with the transverse direction X" means that the main component of the movement is parallel to the transverse direction X, but secondary motion components that are not parallel to the direction X may be provided.

Preferably, the bending die 20 is movable with respect to the sheet metal presser 10 substantially in parallel with the X direction that is transverse to said first 12 and second 22 bending edges.

Advantageously, the sheet metal bending machine 1 further comprises a system for positioning and moving the bending die 20 in a controllable manner with respect to the sheet metal presser 10 substantially in parallel with the transverse direction X.

As will be resumed in the following description, first, this system makes it possible to "statically" adjust the distance D between the bending die and the sheet metal presser before the complete bending step. In other words, this system makes it possible to preset the starting distance D by which the sheet metal bending machine is requested to operate during the partial bending step. In this sense, this refers to "static" adjustment, that is net of successive movements in the transverse direction X during completion of the bending process.

Second, this system makes it possible to "dynamically" vary (decrease) the distance D between the bending die and the sheet metal presser during the complete bending step. In other words, this system makes it possible to decrease the distance D from the maximum starting value to a preset minimum value D1, chosen on the basis of the final bending angle $\alpha$ to be obtained. In this sense, this refers to "dynamic" variation, that is caused by movements in the transverse direction X during the completion of the bending process.

In accordance with the preferred embodiment shown in the attached drawings, the system for positioning and moving the bending die 20 may comprise:

- elastic means 50 suitable to move the die 20 away from the sheet metal presser 10; and
- means 60 for pushing the bending die 20 towards the sheet metal presser 10 in a controllable manner in opposition to said elastic means 50.

Advantageously, said means 60 for pushing the bending die 20 are controllable micrometrically.

Figure 11:
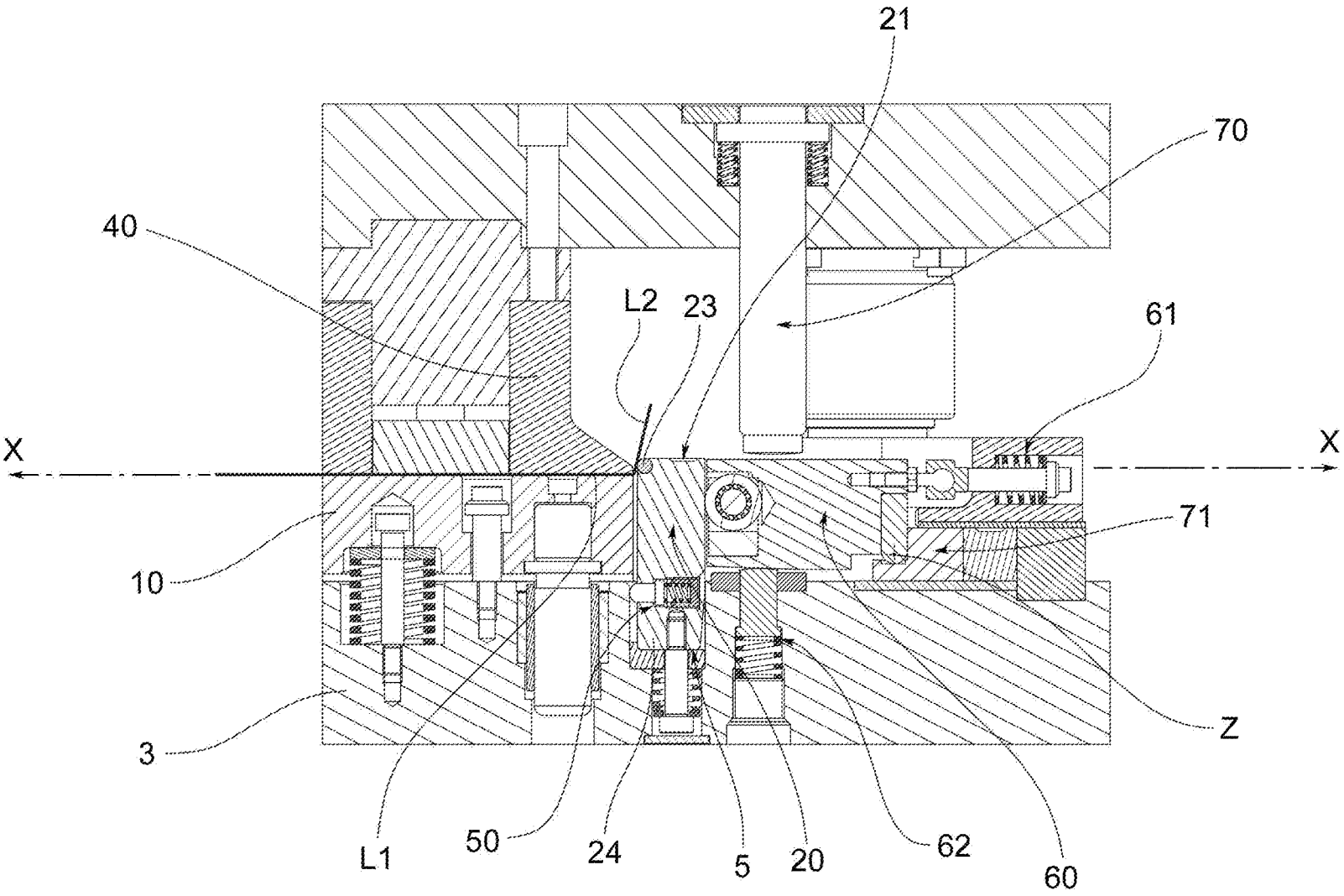
Figure 12:
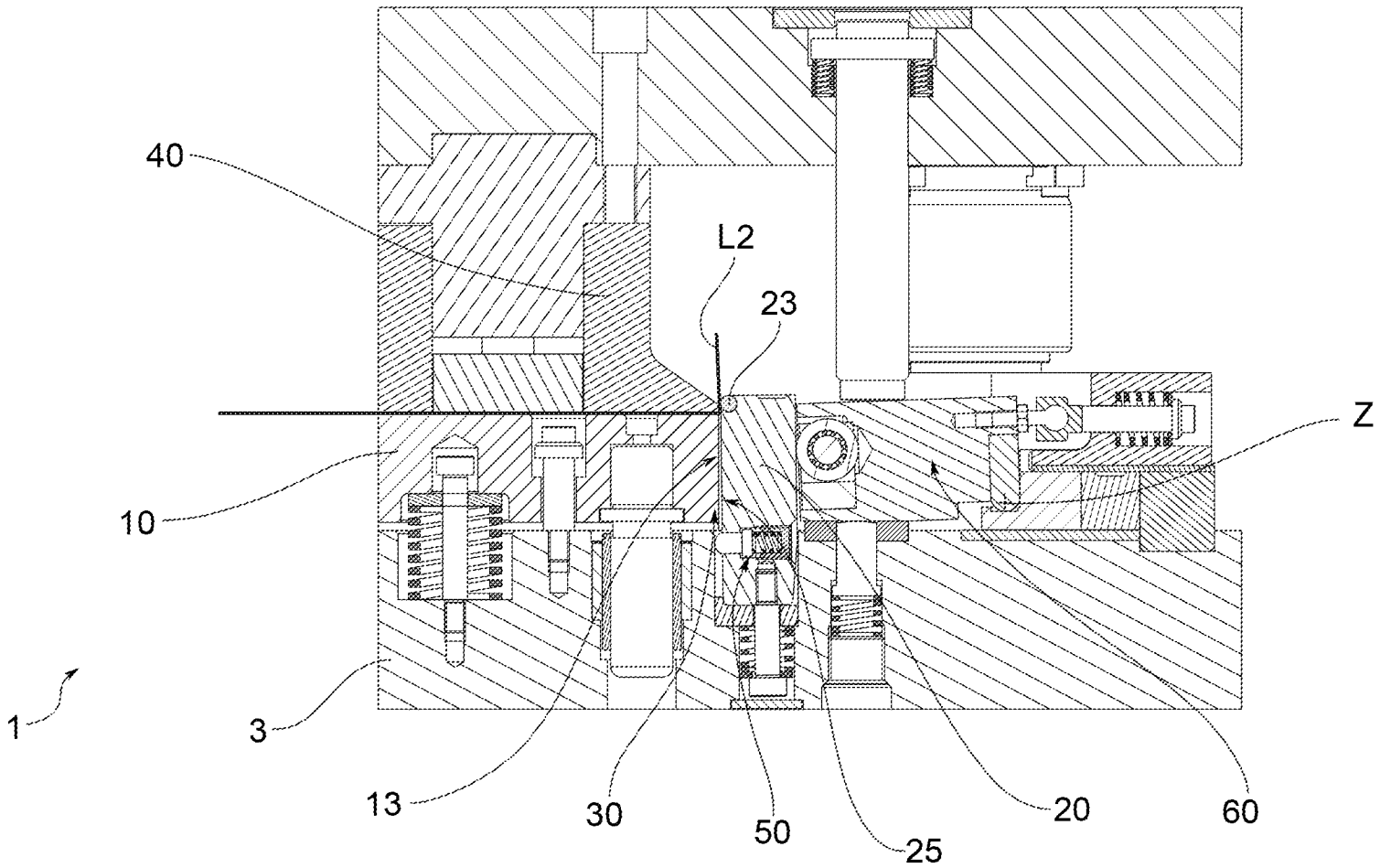
Figure 13:
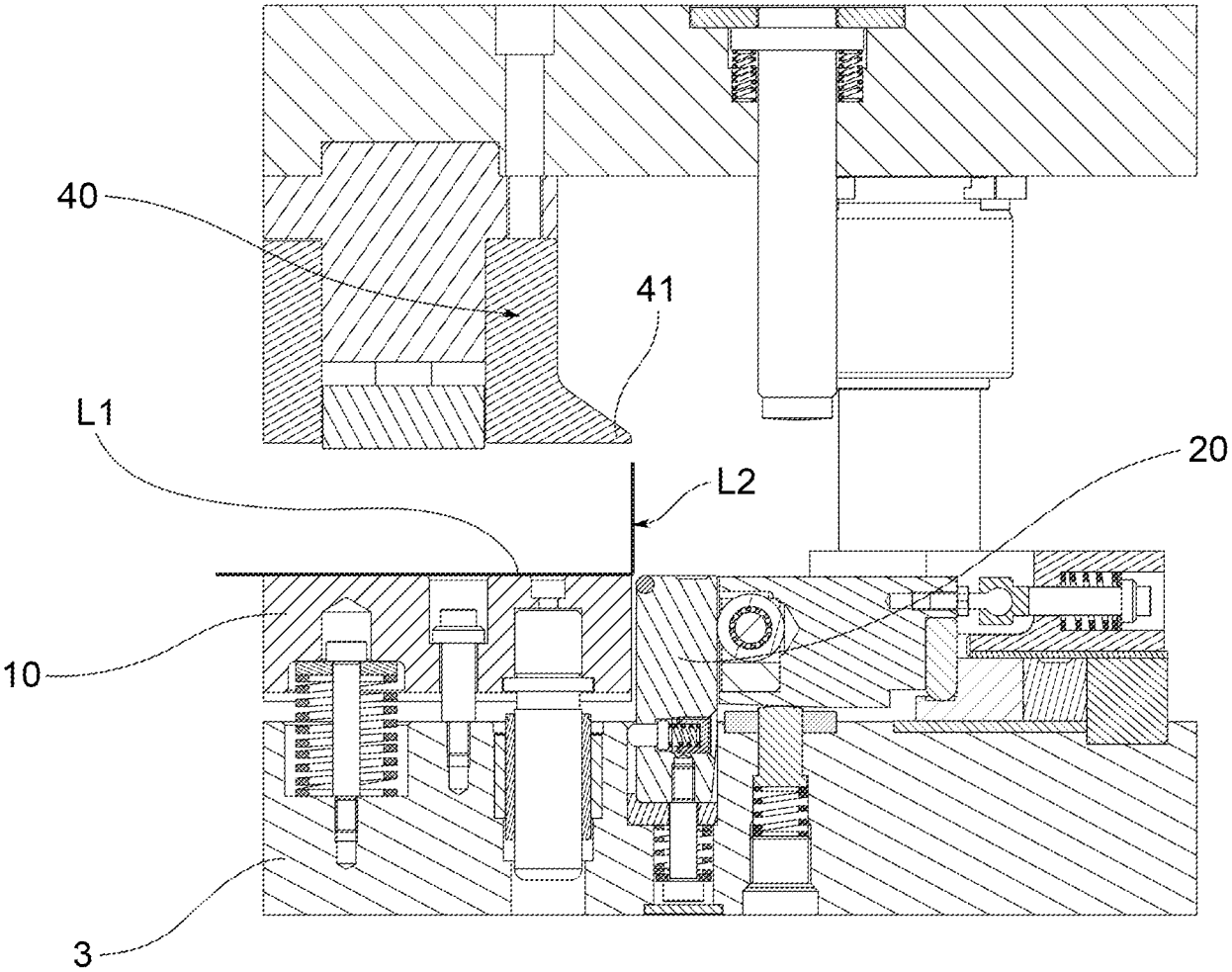

More specifically, in accordance with a particular embodiment shown in FIGS. 11 and 12, the bending die 20 is provided with a base 24 (opposite the second support surface 21). The bending die 20 is partially housed together with said base 24 in a seat 5 made in the lower bench 3 of the support structure 2 of the sheet metal bending machine 1. The bending die 20 extends vertically from the seat 5 beside the sheet metal presser 10 on a first side. The elastic means 50 are positioned inside said seat 5 and are configured to elastically push the bending die 20 in the opposite direction to the sheet metal presser 10. Due to this configuration, the bending die 20 is pivoted on the lower bench 3 at the base 24 thereof, thereby being able to oscillate vertically about an oscillation axis that is substantially parallel to the bending edges.

On a second side of the bending die 20, which is opposite to that where the sheet metal presser 10 is located, a body 60 is arranged that oscillates about an axis of rotation Z substantially parallel to the bending edges 12 and 22. The oscillating body 60 is pivoted on a support bar 71 that extends in a longitudinal direction in parallel with the bending edges 12 and 22 of the bending die 20 and of the sheet metal presser 10.

Operatively, the oscillating body 60 is movable between:

- a passive position, in which it rests on the bending die 20, thereby acting as an end stop for the bending die 20 itself; and
- an active position, in which it opposes the elastic means 50 that move the bending die away from the sheet metal presser 10, pushing the bending die towards the sheet metal presser 10.

The oscillating body 60 is automatically held in the passive position by elastic means 61 and 62.

The passage of the oscillating body from the passive position to the active position is, instead, operated by a controllable actuator 70 (consisting of a pneumatic cylinder, for example) that opposes the elastic means 61 and 62.

The end stop position defined by the oscillating body 60 in its passive position defines the distance D between the bending die 20 and the sheet metal presser 10. This end stop position may be adjusted by adjusting the transverse position (in the transverse X direction) of the support bar 71.

Figure 7:
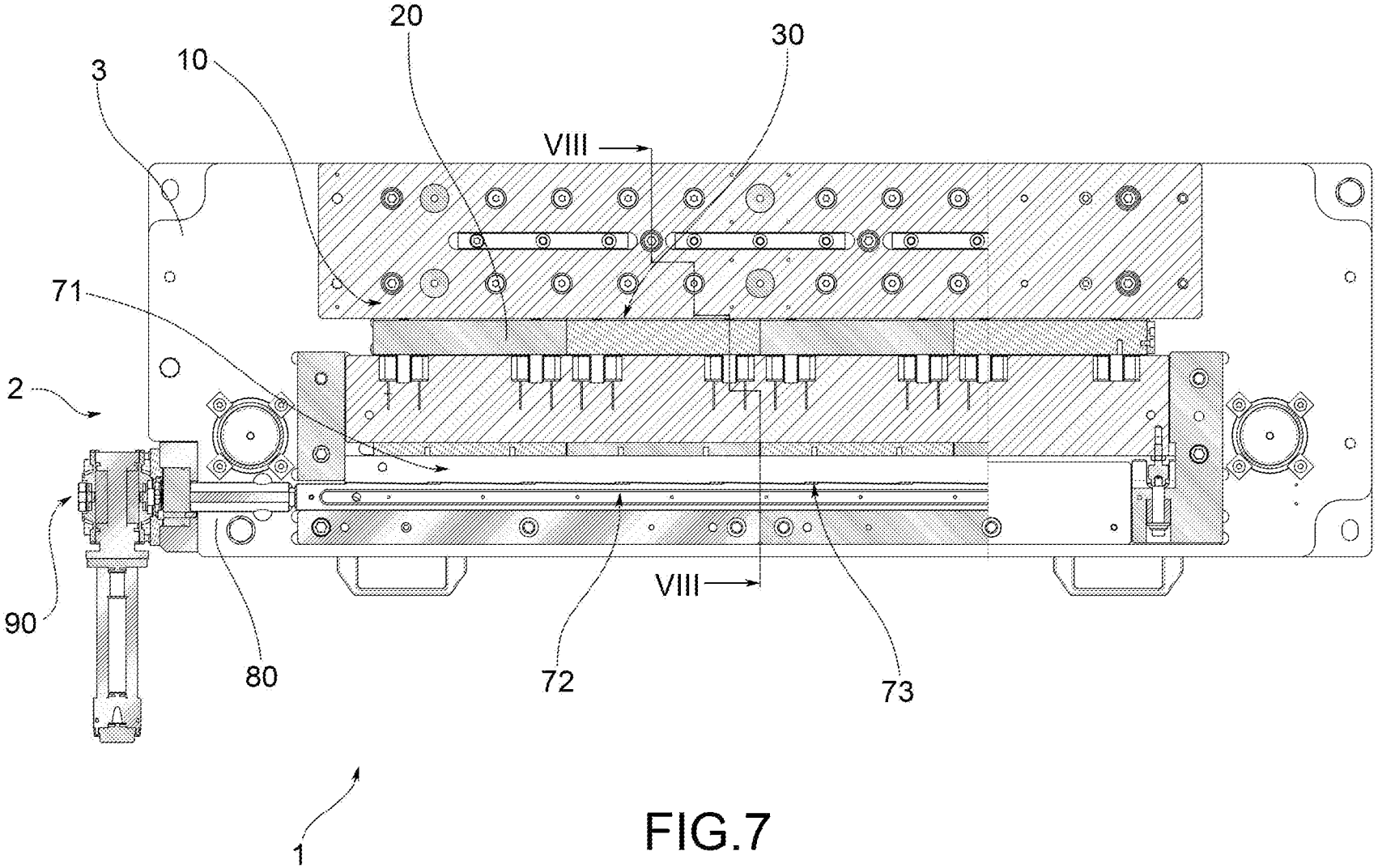
FIG. 7 shows an orthogonal view from above of a section of the bending machine shown in FIG. 6 according to a section plane VII-VII shown therein.
Figure 8:
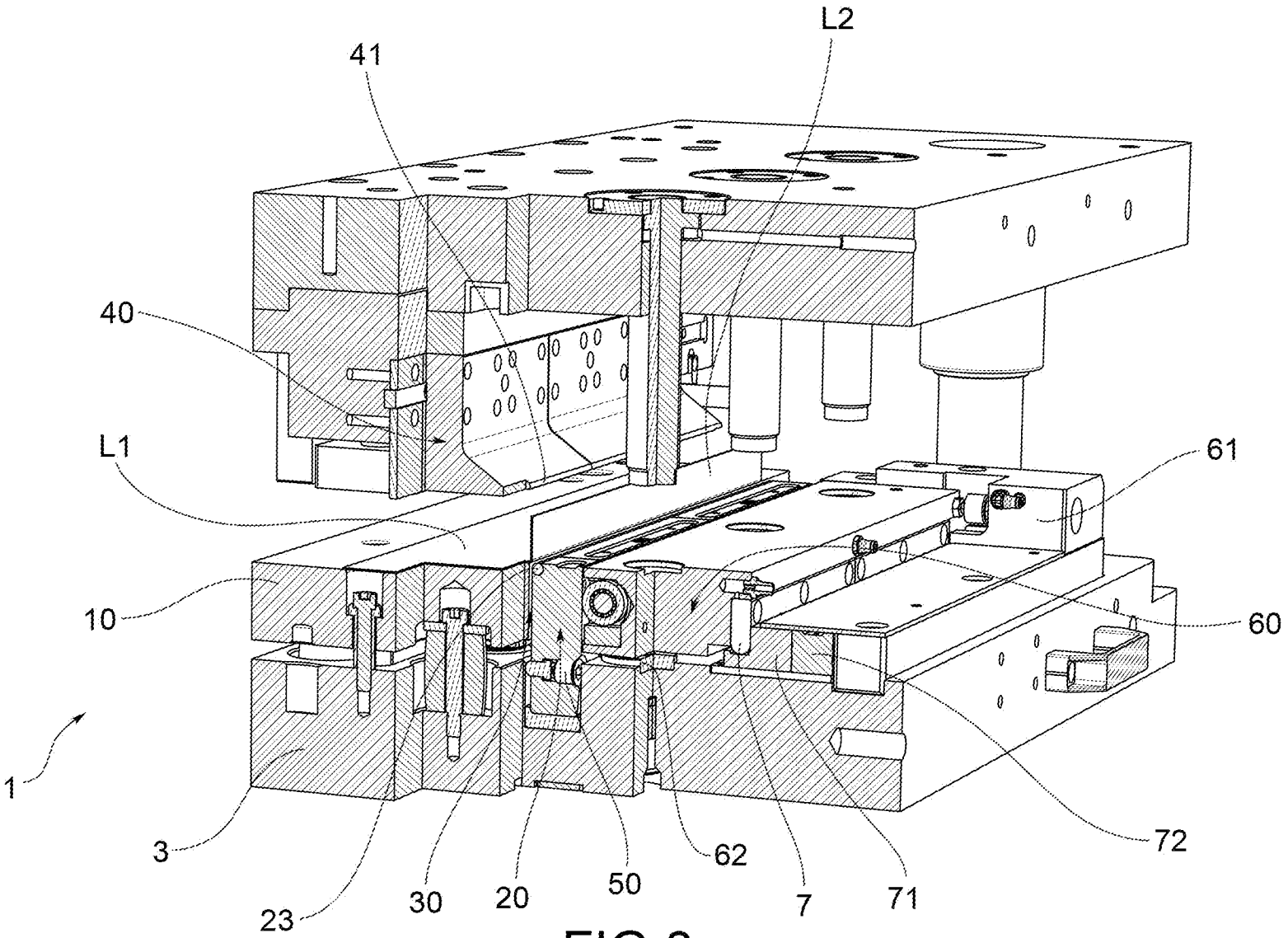
FIG. 8 shows a perspective sectional view of the bending machine in FIG. 5 according to the section plane VIII-VIII shown in FIG. 7.

As shown in FIG. 7, the support bar 71 is longitudinally coupled to an adjustment bar 72 by a profile 73 having a matching shape, which is defined by a plurality of inclined wedges. The adjustment bar 72 is movable longitudinally by means of an axial screw/nut system 80 that may be actuated by motor means 90 and may be micrometrically controlled. Due to the matching-shaped profile 73 having inclined wedges, a longitudinal translational movement of the adjustment bar 72 translates into a micrometrically controlled movement of the support bar 71 in the transverse direction. This controlled movement in the transverse direction translates into a movement of the end stop position defined by the oscillating body and therefore a change in the maximum distance D between the die and the sheet metal presser.

Operatively, once the bending process has been completed, the controllable actuator 70 is deactivated to allow the oscillating body 60 to return to the passive position. In this way, the bending die 20 may move back to the maximum distance D from the sheet metal presser, thereby releasing the sheet metal. At the same time, the bending punch 40 is moved back into the passive position in order to allow the elastically yielding sheet metal presser to return to the initial position. At this point, the bent sheet metal may be removed from the sheet metal bending machine.

The system for positioning and moving the bending die 20 described above is one particular embodiment and may be substituted with equivalent systems.

The present invention relates to a method for bending sheet metal up to a predefined bending angle α.

The bending method comprises the following operating steps:

a) providing a sheet metal bending machine 1 according to the present invention, and in particular as described above;

b) positioning a sheet metal L in the sheet metal bending machine 1 with a first sheet metal portion L1 resting on the sheet metal presser 10 and a second sheet metal portion L2 resting on the bending die 20, in which the sheet metal presser 10 and the bending die 20 are arranged in the sheet metal supporting configuration; and c) locking the first sheet metal portion L1 on the sheet metal presser 10 by bringing the bending punch 40 into the active position.

Figure 16:
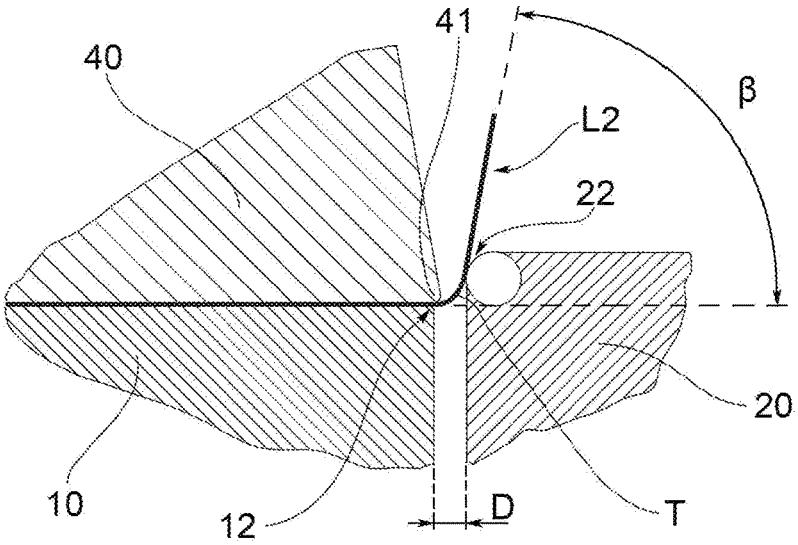

Subsequently, the bending method comprises a step d) of imposing on the second sheet metal portion L2 a partial bending angle β that is smaller than the predefined bending angle α by bringing the bending die 20 and the sheet metal presser 10 into the partial sheet metal bending configuration (FIGS. 11 and 16). In this way, a partially curved section T is generated on the sheet near the punch edge 41, which is deformed in the elastic-plastic field and has an average radius of curvature greater than the radius of curvature R1 of the punch edge 41.

The partial bending step d) is followed by a step e) of completing the bending of said second sheet metal portion L2 (FIGS. 12 and 17) up to said predefined bending angle α by bringing said bending die and said sheet metal presser into the complete sheet metal bending configuration so as to reduce the distance D between the bending die 20 and the sheet metal presser 10 and to press said partially curved section T towards said punch edge 41 in order to further deform it and to increase the curvature of said second sheet metal portion beyond said predefined bending angle α by an additional angle γ that compensates for the elastic return of said sheet.

Figure 17:
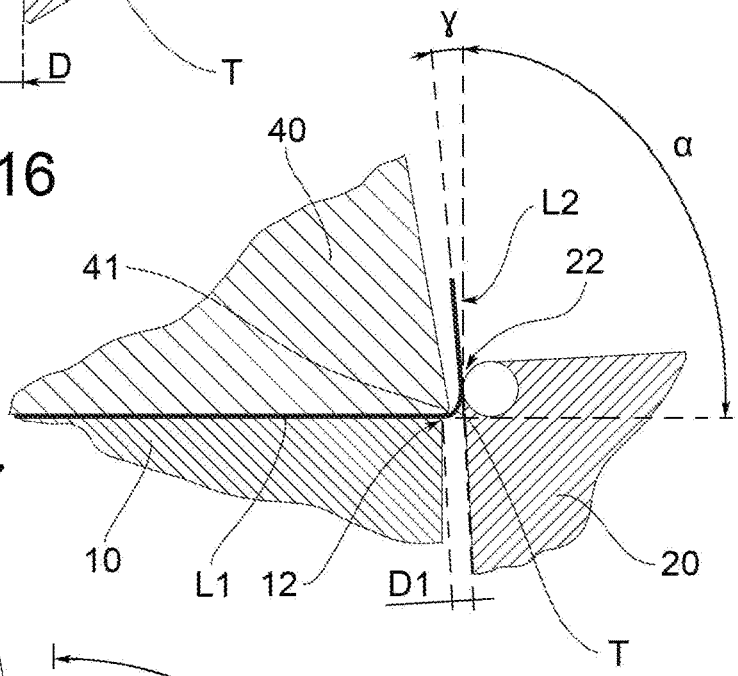
Figure 18:
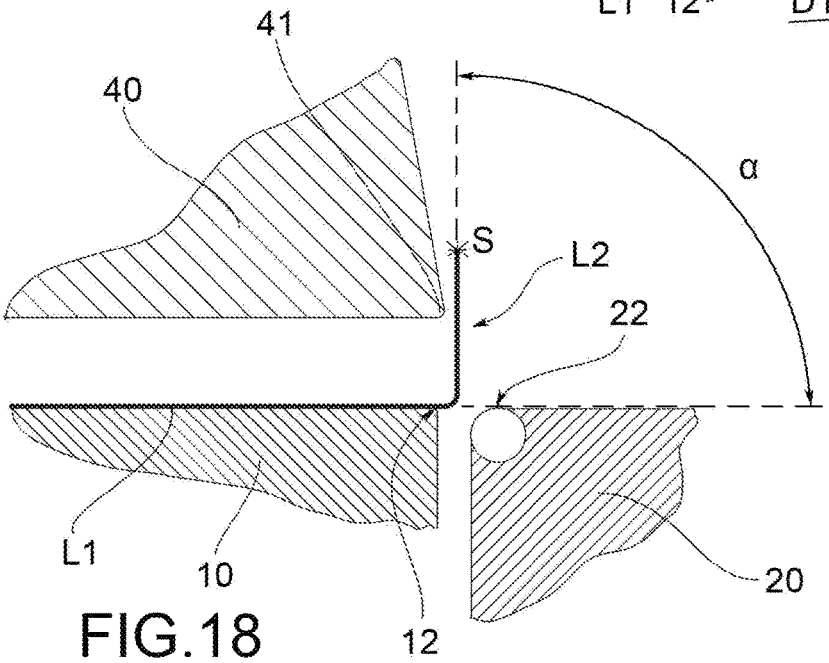

Advantageously, during step e) of completing the bending process, the movement by which the bending die and the sheet metal presser move closer to one another along the transverse direction X may occur also only in the zone in which the respective bending edges 12 and 22 and the punch edge 41 are located, as shown in FIG. 17. In other words, the reduction of the distance from the initial value D to a reduced value D1 may be limited to the bending zone and may not concern the entire gap 30. Again, in other words, the movement by which the bending die and the sheet metal presser move closer to one another may not be perfectly in parallel with the transverse direction X, but for example may comprise other motion components, caused by a slight rotational movement of the bending die with respect to the support base 3.

Advantageously, in step d) of imposing a partial bending angle β on the second sheet metal portion L2, the distance D between the bending die 20 and the sheet metal presser 10, which substantially defines the maximum application arm of the shear force, is chosen on the basis of the thickness S of the sheet to be bent.

Advantageously, in the preferred case in which the movement of the bending die in the orthogonal direction Y with respect to the sheet metal presser (or vice versa) is predefined, the choice of the distance D is made not only on the basis of the thickness S of the sheet, but also on the basis of the partial bending angle β that is intended to be imposed on the sheet metal during the partial bending step d).

Advantageously, during step e) of completing the process of bending the second sheet metal portion L2 up to the predefined bending angle α, the greater the predefined bending angle α, the more the distance D between the die 20 and the sheet metal presser 10 is decreased.

Advantageously, step e) of completing bending is followed by a step f) of resuming the initial configuration of the sheet metal bending machine, in which the bending die and the sheet metal presser are moved back into the sheet supporting configuration so as to be spaced apart from one another by the distance D and at the same time the punch is moved back into the passive position. In this situation, the bent sheet may be freely extracted from the sheet metal bending machine.

The present invention makes it possible to obtain numerous advantages, some of which have already been described.

The sheet metal bending machine according to the present invention makes it possible to adjust the bending angle of the sheet and is simultaneously mechanically simple to produce and to control.

Moreover, the sheet metal bending machine according to the present invention is able to bend sheet metal, simultaneously preserving the surface integrity thereof due to the presence of an idle roller at the bending edge of the bending die.

In addition, the sheet metal bending machine according to the present invention is simple and economic to produce.

Lastly, the sheet metal bending machine according to the present invention is operatively simple to manage.

Therefore, the present invention meets the set objects.

The method for bending sheet metal according to the present invention makes it possible to adjust the bending angle of the sheet and is simultaneously mechanically simple to implement. In fact, as previously described, it does not require the use of machines having particularly complex drives and mechanisms.

During practical implementation thereof, it may also assume embodiments and configurations that differ from those illustrated above, without thereby departing from the scope of protection as described and claimed herein.

Furthermore, all features may be substituted by technically equivalent elements, and any dimensions, embodiments and materials may be used, depending on requirement.

What is claimed is:

1. A sheet metal bending machine comprising:

a sheet metal presser, which defines on its top a first support surface to support a first sheet metal portion, said first support surface being partially delimited by a first bending edge, a bending punch movable with respect to said first support surface between a passive position, in which it is raised with respect to said first support surface, and an active position, in which it is pressed against said first support surface to lock in use said first sheet metal portion on the sheet metal presser with a punch edge arranged near said first bending edge, a bending die, which defines on its top a second support surface intended to support a second sheet metal portion, said second support surface being partially delimited by a second longitudinal bending edge, wherein said bending die is positioned at a distance (D) from said sheet metal presser with said second bending edge parallel to and opposite to said first bending edge, wherein said sheet metal presser and said bending die are movable relative to one another substantially in parallel with a direction (Y) orthogonal to said first and second support surfaces to pass between a sheet metal supporting configuration, in which the first and the second support surfaces with the first and second bending edges are coplanar with each other and define in use a support plane for unbent sheet metal, and a partial sheet metal bending configuration, wherein, with said bending punch in the active position, the second support surface with the second bending edge is positioned higher than said first support surface so as to incline the second sheet metal portion in use with respect to the first sheet metal portion, generating in use on sheet metal near said punch edge a partially curved section deformed in an elastic-plastic field, wherein an oscillating body, arranged on a side of said bending die, oscillates about an axis parallel to the first and second bending edges such that, in the passive position, said oscillating body acts as an end stop for said bending die, and in the active position, said oscillating body pushes said bending die towards said sheet metal presser, wherein said sheet metal presser and said bending die are movable relative to one another substantially in parallel with a direction (X) transverse to said first and second bending edges to switch in use from said partial sheet metal bending configuration to a complete sheet metal bending configuration, in which the bending die and the sheet metal presser are moved closer to one another, reducing the distance (D) to press in use said partially curved section towards said punch edge, deforming it further and increasing a curvature of said sheet metal, and wherein a bending angle imposed on said sheet metal is adjusted by controlling movement between said sheet metal presser and said bending die.

2. The sheet metal bending machine of claim 1, wherein along said second bending edge an idle roller is positioned, rotatably associated with the body of said bending die with rotation axis parallel to said second bending edge.

3. The sheet metal bending machine of claim 1, wherein said sheet metal presser is movable with respect to said bending die substantially parallel to a direction orthogonal to said first and second support surfaces.

4. The sheet metal bending machine of claim 2, wherein said sheet metal presser consists of a support elastically yielding under a thrust of said bending punch.

5. The sheet metal bending machine of claim 1, wherein said bending die is movable with respect to said sheet metal presser substantially parallel to a direction transverse to said first and second bending edges.

6. The sheet metal bending machine of claim 5, further comprising a system configured to controllably position and move said bending die with respect to said sheet metal presser.

7. The sheet metal bending machine of claim 6, wherein said system comprises:

a support bar configured to move said bend die away from said sheet metal presser, and an adjustment bar configured to controllably push said bending die towards said sheet metal presser in opposition to a first unit.

8. The sheet metal bending machine of claim 7, wherein the support bar and the adjustment bar are micrometrically controllable.

9. The sheet metal bending machine of claim 1, wherein said side of said bending die where said oscillating body is arranged is opposite to said sheet metal presser.

10. The sheet metal bending machine of claim 1, wherein passage of said oscillating body from the passive position to the active position is operated by a controllable actuator.

11. A method for bending sheet metal up to a predefined bending angle ($\alpha$), the method comprising the following operating steps:

a) providing a sheet metal bending machine according to claim 1;

b) positioning sheet metal in said sheet metal bending machine with a first sheet metal portion resting on the sheet metal presser and a second sheet metal portion resting on the bending die, said sheet metal presser and said bending die being arranged in said sheet metal supporting configuration;

c) locking said first sheet metal portion on said sheet metal presser by bringing said bending punch into said active position;

d) imposing on said second sheet metal portion a partial bending angle ($\beta$) lower than said predefined bending angle ($\alpha$) by bringing said bending die and said sheet metal presser into said partial sheet metal bending configuration to generate on sheet metal near said punch edge a partially curved section, deformed in the elastic-plastic field, having an average curvature radius greater than the curvature radius of said punch edge;

e) completing bending of said second sheet metal portion up to said predefined bending angle ($\alpha$), by bringing said bending die and said sheet metal presser into said complete sheet metal bending configuration, to reduce the distance (D) between the bending die and the sheet metal presser and to press said partially curved section towards said punch edge to further deform it and increase curvature of said second sheet metal portion beyond said predefined bending angle ($\alpha$) by an additional angle ($\gamma$) that compensates for an elastic return of sheet metal, wherein the predefined bending angle is adjusted by controlling movement between said sheet metal presser and said bending die.

12. The method of claim 11, wherein in step d) of imposing on said second sheet metal portion a partial bending angle (β) the distance (D) between the bending die and the sheet metal presser is chosen according to the thickness of the sheet metal to be bent.

13. The method of claim 11, wherein in step e) of completing the bending of said second sheet metal portion up to said predefined bending angle (α), as the predefined bending angle (α) gets wider, the distance (D) between the bending die and the sheet metal presser is decreased more.

* * * * *